US005333938A

United States Patent [19]

Gale

[11] Patent Number: 5,333,938

[45] Date of Patent: Aug. 2, 1994

[54] CUTTER BIT

[75] Inventor: Preston L. Gale, Morton, Ill.

[73] Assignee: Caterpillar Inc., Peoria, Ill.

[21] Appl. No.: 82,708

[22] Filed: Jun. 28, 1993

[51] Int. Cl.[5] ..... F21B 10/50; E21C 35/18

[52] U.S. Cl. ..... 299/86; 407/7; 407/64

[58] Field of Search ..... 299/79, 86; 175/331, 175/427; 172/719, 772, 772.5; 407/7, 42, 64

[56] References Cited

U.S. PATENT DOCUMENTS

| | | | |
|---|---|---|---|
| 4,699,549 | 10/1987 | Shimomura et al. | 407/42 |
| 4,730,681 | 3/1988 | Estes | 175/39 |
| 4,738,291 | 4/1988 | Isley | 144/34 R |
| 5,078,219 | 1/1992 | Morrell et al. | 299/86 X |
| 5,261,499 | 11/1993 | Grubb | 175/427 |

FOREIGN PATENT DOCUMENTS

| | | | |
|---|---|---|---|
| 697716 | 11/1979 | U.S.S.R. | 299/86 |
| 1029841A | 7/1983 | U.S.S.R. . | |

OTHER PUBLICATIONS

Proceedings of International Symposium of Mine Mechanization and Automation, Golden, CO, Jun. 10-13, 1991, "The Development and Testing of the Concave Bit", by D. A. Larson et al.

*Primary Examiner*—David J. Bagnell
*Attorney, Agent, or Firm*—Robert A. McFall

[57] ABSTRACT

A cutter bit having a concave face surface has a base surface spaced from the concave face surface and a recess extending inwardly from the base surface, The recess is adapted to receive a portion of a tool holder that extends at least partially into the recess, A bearing member is interposed the body of the cutter bit and the portion of the tool holder disposed in the recess.

3 Claims, 1 Drawing Sheet

CUTTER BIT

TECHNICAL FIELD

This invention relates generally to a cutter bit and more particularly to a rotatable cutter bit having a concave facial surface.

BACKGROUND ART

Cutter bits having a concave facial surface have been proposed for use in certain mining and agricultural applications. For example, a concave cutter bit mounted on, or attached to, a shank that is rotatably mounted in the bore of a tool holder is shown in U.S. Pat. No. 5,078,219, issued Jan. 7, 1992 to Roger J. Morrell, et al. A significant advantage of such cutting tools is that they are capable of rotation during operation, thereby distributing wear of the cutting edge around the outer peripheral edge of the concave face surface.

However, it has been found that, during operation, dust and small particles of cut material tend to pack around the shank of the concave bits constructed according to the teaching of Morrell, et al. Furthermore, fine particles are forcibly driven into the joint between tool shank and the receiving socket in the tool holder. These problems inhibit the rotation of the tool during cutting operations and prevents even wear distribution about the peripheral edge of the tool.

The present invention is directed to overcoming the problems set forth above. It is desirable to have a concave cutting tool in which the rotary connection between the tool and tool holder is protected against direct penetration of foreign material. It is also desirable to have a concave cutter bit arrangement that has an internal bearing member that further contributes to the free rotation of the cutting tool during operation.

DISCLOSURE OF THE INVENTION

In accordance with one aspect of the present invention, a cutter bit includes a body having a concave face surface and a base surface spaced from the face. The body is rotatable about a central axis extending through the body normal to the face and base surfaces. The bit has an internally disposed recess extending inwardly from the base surface towards the face surface. A bearing is positioned in the recess between the body and the tool holder.

In another aspect of the present invention, the internal recess extends through the body from the base surface to the face surface and the tool holder includes a bolt having a head portion abutting the bearing disposed in the body recess.

BEST MODE FOR CARRYING OUT THE INVENTION

Figure 1:
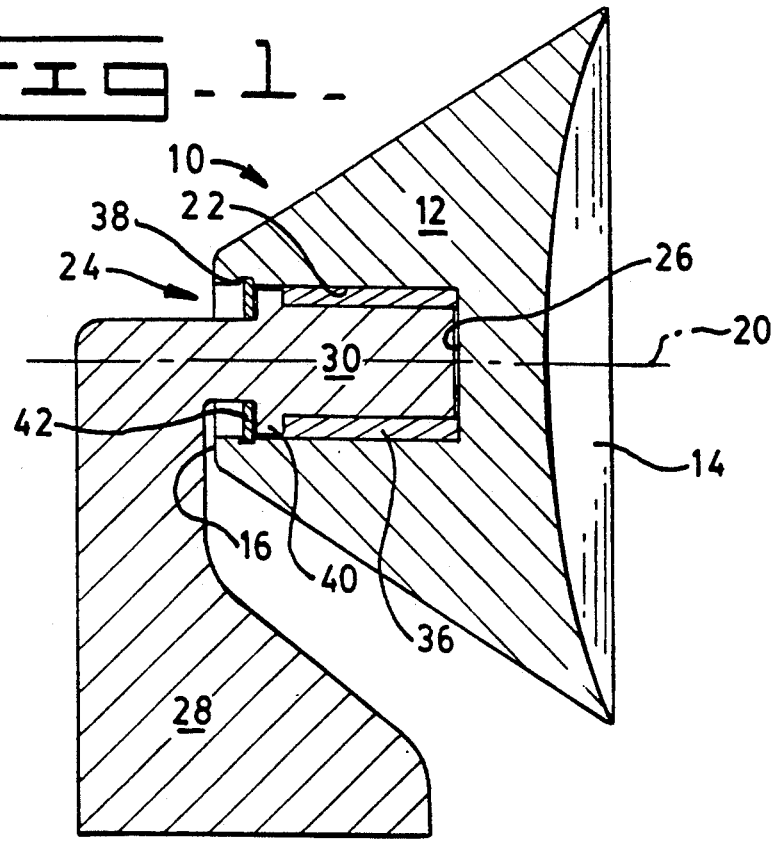
FIG. 1 is a sectional view of the cutter bit embodying the present invention.
Figure 2:
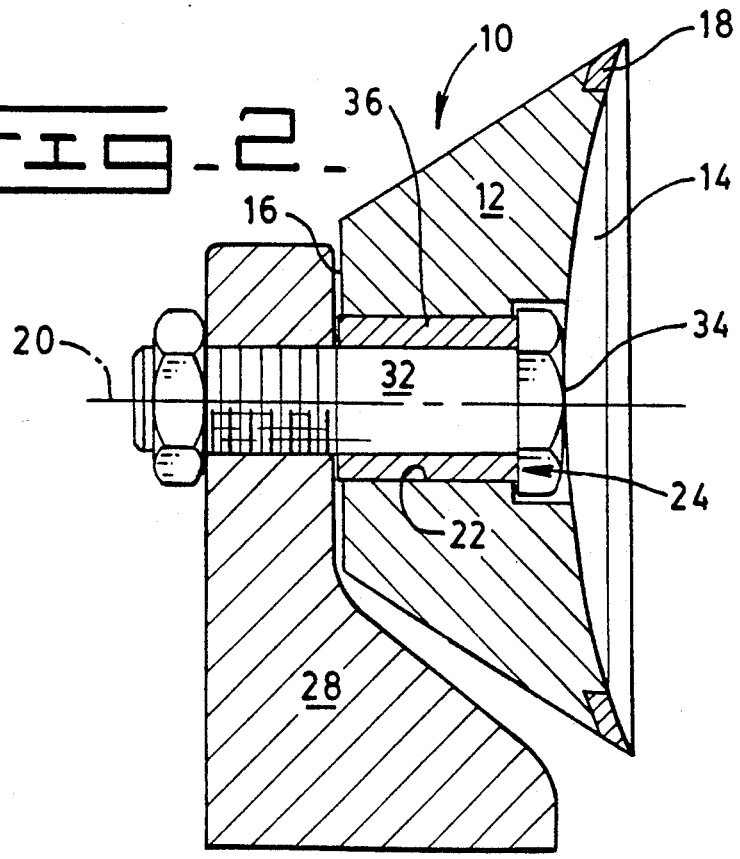
FIG. 2 is a sectional view of a second embodiment of the cutter bit embodying the present invention.

Cutting tools 10, embodying the present invention, are shown in FIGS. 1 and 2, comprise a body 12 characterized by having a concave face surface 14 and a base surface 16 spaced from the face surface. The word "concave" as used herein with respect to the face surface 14 means a surface that extends inwardly from an outer edge and may be curved, i.e., rounded like the inside of a bowl, or straight, i.e., having a shallow V-shape. The bottom of the concavity may be rounded, flat, or come to a point. The concave face surface 14 is preferably formed of hardened steel, or alternatively for purposes of increasing the wear life, may include an insert 18 of a wear resistant material such a tungsten carbide, as shown in FIG. 2.

An important characteristic of concave cutter bits is that they are capable of rotation about an axis 20 extending through the center of the body 12. Also, as may be seen by studying FIGS. 1 and 2, the concave face surface 14 and the base surface 16 are each normal to the axis 20.

Cutting bits embodying the present invention do not have a shank portion common to prior art concave cutting bits. Importantly, the concave cutter bits 10 embodying the present invention have an internal wall surface 22 extending inwardly from the base surface 16 in a direction towards the face surface 14.

In the embodiment illustrated in FIG. 1, the internal wall surface 22 forms a recess 24 that is essentially a blind-bottom bore terminating at a bottom wall 26 in the body 12. In the second embodiment shown in FIG. 2, the recess 24 is a bore hole extending completely through the body 12.

The cutter bit 10 is mounted on a tool holder 28 that, for the arrangement shown in FIG. 1 includes a stub shaft 30 that, when the cutter bit is assembled thereon, extends into the recess 24 of the body. In the other arrangement, shown in FIG. 2, the tool holder includes a bolt 32 coaxially aligned with the body axis 20. The bolt 32 has a head end that when assembled is adjacent, but not touching, the face surface 14 of the cutting tool 10. The body of the bolt 32 is preferably smooth and forms a shaft for supporting the cutter bit 10 when assembled thereon.

Importantly, the cutter bit 10 embodying the present invention includes bearing means 36 that is interposed the internal wall surface 22 of the cutter bit and the tool holder 28. Preferably, the bearing means 36 is a sleeve bearing and is mounted in coaxial alignment with the body axis 20 between the internal wall surface 22 and, depending on the particular embodiment, either the stub shaft 30 or the bolt shaft 32 of the tool holder 28.

In the cutter bit arrangement shown in FIG. 1, the internal wall surface 22 has an annular groove 38. The annular groove is disposed near the base surface 16 and extends radially outwardly with respect to the axis 20. In this arrangement, the tool holder 28 has a stepped shoulder 40 that provides an abutment surface for a snap ring 42. The snap ring 42 has a diameter that, when engaged in the annular groove 38, inhibits removal of the cutter bit 10 from the tool holder 28. In this arrangement, the shoulder 40 also serves as an abutment surface for one end of the sleeve bearing 36. Desirably, the other end of the sleeve bearing 36 abuts the bottom wall 26 of the recess 24 and prevents the bottom wall from rubbing directly against the tool holder during operation.

In the second cutter bit arrangement, the head end 34 of the bolt 32 abuts the sleeve bearing 36 when tightened by means of a nut, as shown in FIG. 2, or by threads provided in the tool holder 28. Thus, the bearing 36 acts as a spacer to prevent the bolt head 34 from engagement with the face surface 14 of the cutter bit.

INDUSTRIAL APPLICABILITY

The cutter bit 10 is particularly useful for mining mineral materials that, when cut, produce a significant amount of fine powder and dust. Coal and gypsum are two examples of such materials. In the current concave bit arrangements in which the body of the bit includes a shank portion, the fine particles readily pack around the shank and into the shank-tool holder interface, thereby preventing rotation of the bit. Thus, in these situations, the face surface of the bit wears at only one place on the circular outer periphery and must be replaced, even though the remaining peripheral edge of the bit is still sharp.

In the cutter bit 10 embodying the present invention, the bit has no shank and the interface connection between the bit and the tool holder is recessed in the body 12 of the bit at a position that is shielded and not prone to becoming packed with debris during operation.

Also, the cutter bit 10 embodying the present invention includes a bearing element 36 disposed in the bit recess 24. The bearing element supports the bit 10 about the axis of rotation 20 and increases the ease of rotation of the bit 10 during operation. Furthermore, the bearing elements 36 are easily replaceable and prevent wear of the tool holder stub shaft 30 or bolt shaft 32.

Other aspects, objects and advantages of this invention can be obtained from a study of the drawings, the disclosure, and the appended claims.

What is claimed is:

1. A cutter bit rotatably mountable on a tool holder, comprising:

a body having a concave face surface and a base surface spaced from said face surface, said body being rotatable about a centrically disposed axis extending through the body normal to said face and base surfaces;

an internal wall surface concentrically disposed about said axis and extending inwardly from said base surface towards said face surface, said internal wall surface defining a recess in said body; and bearing means interposed said internal wall surface and said tool holder in coaxial alignment with said body axis.

2. A cutter bit, as set forth in claim 1, wherein said internal wall surface extends through said body, said recess in said body being a bore extending from said base surface to said face surface, and said tool holder includes a bolt member coaxially aligned with said body axis and having a head portion abutting said bearing means.

3. A cutter bit, as set forth in claim 1, wherein said internal wall surface includes an annular groove adjacent said base surface and extending radially outwardly from said axis, and said tool holder includes a snap ring engageable in said annular groove.

* * * * *